US006232940B1

(12) United States Patent
Ohno et al.

(10) Patent No.: US 6,232,940 B1
(45) **Date of Patent: *May 15, 2001**

(54) PICTURE DATA TRANSFER CONTROL APPARATUS AND DISPLAY APPARATUS

(75) Inventors: Tomoyuki Ohno, Atsugi; Atsushi Mizutome, Kanagawa-ken, both of (JP)

(73) Assignee: Canon Kabushiki Kaisha, Tokyo (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 08/991,857

(22) Filed: Dec. 16, 1997

(30) Foreign Application Priority Data

Dec. 19, 1996 (JP) ..... 8-340113
Dec. 8, 1997 (JP) ..... 9-337536

(51) Int. Cl.[7] ..... G09G 3/36

(52) U.S. Cl. ..... 345/94; 345/99; 345/95; 345/103; 345/98

(58) Field of Search ..... 345/98–103, 204, 345/94, 87, 212, 213, 205, 55

(56) References Cited

U.S. PATENT DOCUMENTS

| | | | | |
|---|---|---|---|---|
| 4,779,085 | | 10/1988 | Mizutome et al. | 340/805 |
| 4,795,239 | | 1/1989 | Yamashita et al. | 350/333 |
| 4,922,241 | | 5/1990 | Inoue et al. | 340/784 |
| 4,952,032 | | 8/1990 | Inoue et al. | 350/350 S |
| 5,103,218 | * | 4/1992 | Takeda | 345/100 |
| 5,233,446 | | 8/1993 | Inoue et al. | 359/55 |
| 5,345,250 | | 9/1994 | Inoue et al. | 345/100 |
| 5,359,344 | | 10/1994 | Inoue et al. | 345/100 |
| 5,734,378 | * | 3/1998 | Okada et al. | 345/204 |
| 5,771,031 | * | 6/1998 | Kinoshita et al. | 345/98 |

FOREIGN PATENT DOCUMENTS

| | | |
|---|---|---|
| 0 740 285 | 10/1996 | (EP) . |
| 0 760 508 | 3/1997 | (EP) . |
| 2 155 221 | 9/1985 | (GB) . |
| 2 162 984 | 2/1986 | (GB) . |

OTHER PUBLICATIONS

U.S. application No. 08/540,137, filed Oct. 6, 1995.
U.S. application No. 08/636,496, filed Apr. 23, 1996.
U.S. application No. 08/636,496, filed Apr. 23, 1996.

* cited by examiner

*Primary Examiner*—Dennis-Doon Chow
*Assistant Examiner*—Amr Awad
(74) *Attorney, Agent, or Firm*—Fitzpatrick, Cella, Harper & Scinto

(57) ABSTRACT

A display apparatus, such as a liquid crystal display apparatus, includes a display panel having scanning lines and data lines arranged in a matrix form, and a driver for applying scanning signals and data signals to the scanning lines and data lines, respectively, so as to display a picture on the display panel. The driver includes a plurality of data line drivers disposed so as to apply data signals to the data lines, and a picture data transfer controller for transferring picture data for one scanning line drive period to the plurality of data line drivers. The picture data transfer controller further includes a supplier for supplying a signal for setting a period for intermission of picture data transfer during a period for transferring the picture data for one scanning line drive period to the plurality of data lines. As a result, the processing load on the picture data transfer controller can be reduced, and a cascade connection between data line drivers leading to a mal-operation due to noise can be alleviated.

14 Claims, 18 Drawing Sheets

| NUMBER OF COUNTED CLOCK SIGNALS | CID0 | CID1 | CID2 | CID3 | CID4 |
|---|---|---|---|---|---|
| 1 | 0 | 0 | 0 | 0 | 0 |
| 21 | 1 | 0 | 0 | 0 | 0 |
| 41 | 0 | 1 | 0 | 0 | 0 |
| 61 | 1 | 1 | 0 | 0 | 0 |
| 81 | 0 | 0 | 1 | 0 | 0 |
| 101 | 1 | 0 | 1 | 0 | 0 |
| 121 | 0 | 1 | 1 | 0 | 0 |
| 141 | 1 | 1 | 1 | 0 | 0 |
| 161 | 0 | 0 | 0 | 1 | 0 |
| 181 | 1 | 0 | 0 | 1 | 0 |
| 201 | 0 | 1 | 0 | 1 | 0 |
| 221 | 1 | 1 | 0 | 1 | 0 |
| 241 | 0 | 0 | 1 | 1 | 0 |
| 261 | 1 | 0 | 1 | 1 | 0 |
| 281 | 0 | 1 | 1 | 1 | 0 |
| 301 | 1 | 1 | 1 | 1 | 0 |
| 321 | 0 | 0 | 0 | 0 | 1 |
| 341 | 1 | 0 | 0 | 0 | 1 |
| 361 | 0 | 1 | 0 | 0 | 1 |
| 381 | 1 | 1 | 0 | 0 | 1 |
| 401 | 0 | 0 | 1 | 0 | 1 |
| 421 | 1 | 0 | 1 | 0 | 1 |
| 441 | 0 | 1 | 1 | 0 | 1 |
| 461 | 1 | 1 | 1 | 0 | 1 |
| 481 | 0 | 0 | 0 | 1 | 1 |
| 501 | 1 | 0 | 0 | 1 | 1 |
| 521 | 0 | 1 | 0 | 1 | 1 |
| 541 | 1 | 1 | 0 | 1 | 1 |
| 561 | 0 | 0 | 1 | 1 | 1 |
| 581 | 1 | 0 | 1 | 1 | 1 |
| 601 | 0 | 1 | 1 | 1 | 1 |
| 621 | 1 | 1 | 1 | 1 | 1 |

FIG. 9

PICTURE DATA TRANSFER CONTROL APPARATUS AND DISPLAY APPARATUS

FIELD OF THE INVENTION AND RELATED ART

The present invention relates to a display apparatus and particularly an apparatus for controlling transfer of picture data, i.e., for effecting optimum data signal transfer to a data line driver for supplying data signals to data lines.

In a flat panel display (hereinafter called "FPD") as an example of a display apparatus comprising scanning lines and data lines arranged in a matrix form to provide a display panel and applying scanning signals and data signals thereto to display a picture, it has been necessary to collectively transfer picture data for one line (scanning line) since the display of FPD is performed according to a line-sequential scanning scheme, or a point-sequential scanning scheme wherein a plurality of pixels on a selected line are time-serially selected and driven for determination of a display state during one-line selection period. More specifically, in a conventional type of display, a data side (segment) driver is required to transfer display data for all the number of bits in synchronism with the frame frequency.

FIG. 15 is a block diagram of a system for effecting a conventional scheme of data transfer. Referring to FIG. 15, the system includes a liquid crystal display panel 1, a plurality of segment drivers (data line drivers) 2, a plurality of common drivers (scanning line driver) 3, segment bus boards 4, a common bus board 5, a liquid crystal driver controller 6, a picture data bus 7, a clock signal line 8, a latch signal line 9, a cascade input signal line 10, a segment control line (including a power supply line) 11 and a common control line (including a power supply line) 12.

Further, FIG. 16 is a block diagram for illustrating the connection of segment drivers in such a conventional data transfer system. Referring to FIG. 16, respective segment drivers 21, 22, 23, . . . are supplied with picture data ID (0:7) from the picture data bus 7, clock signals from the clock signal line 6 and LATCH signals from the latch signal line 9.

On the other hand, a first segment driver 21 is connected in cascade with the cascade input signal line 10 and is supplied with a cascade input signal SDI from the controller 6 through the cascade input signal line 10 (other control lines being connected as input lines but omitted from showing here). Further, the first segment driver 21 is designed to output a cascade output signal SDO1 at a prescribed time after receiving the cascade input signal SDI from the controller 6.

The cascade output signal SDO1 is inputted to a second segment driver 22, which outputs a cascade output signal SDO1 at a prescribed time thereafter. Further, the cascade output signal SDO2 is inputted to a third segment driver 22, which outputs a cascade output signal SDO3 at a prescribed time thereafter.

Picture data supplied to the segment drivers 2 is transferred in a width of 8 bits (8 bit parallel), and the picture data for all the drivers is serially transferred, as illustrated in a time chart shown in FIG. 17. In synchronism with transfer of first data d0–d7 among the picture data, the cascade input signal SDI is made high ("H") for one cycle period of the clock signal.

Based on "H" of the first cascade input signal SDI, the first segment driver 21 samples picture data and simultaneously counts the number of clock signals by an internal control circuit 2A therein as shown in FIG. 18. In this prior art example, each segment driver (21, 22 or 23) has 160 output pins, so that picture data for one scanning line drive period for one segment driver (21, 22 or 23) is completed by sampling 160 bits of picture data, i.e., 8 bit width picture data×20 clock signals.

Accordingly, when 20 clock signals are counted, the data sampling by the first segment driver is completed, and the cascade output signal SDO1 is made high (H) for one cycle period of clock signal. Then, by "H" of the cascade output signal SDO1, the second segment driver 22 samples picture data, and thereafter based on "H" of the cascade output signal SDO2, the third segment driver 23 samples picture data.

As described above, picture data ID0–ID159 are stored in the first segment drive 21; picture data ID160–ID319 are stored, in the second segment driver 22, and picture data ID320–ID479 are stored in the third segment driver, whereby picture data for one scanning line drive period is completed.

On the other hand, in a display apparatus based on such a conventional data transfer scheme, the segment drivers are required to collectively transfer all the number of bits of picture data for one scanning line in synchronism with the frame frequency as described above. Now, in order to collectively effect data transfer of all the number of bits for one scanning line, the liquid crystal drive controller as the picture data transfer control means is required to include at least a number of registers corresponding to all the number of bits for one scanning line, i.e., 160 times the number of segment drivers in the example of FIG. 18.

However, as the volume of transfer picture data is increased accompanying development of a larger picture area (screen size), a higher resolution and an increased number of colors of display apparatus, the processing load on the liquid crystal drive controller is liable to be increased in the case of collectively transferring picture data for one scanning line. Further, even in the case where picture data transfer is desired to be interrupted based on a demand of a controller or a system including the controller, it has been necessary to wait until the completion of picture data transfer for one scanning line. Further, in the case of cascade connection between the segment drivers, if a noise is carried into an SDI signal, all the drivers are liable to cause mal-function.

SUMMARY OF THE INVENTION

Accordingly, a principal object of the present invention is to provide a display apparatus capable of reducing the processing load on a picture data transfer controller side at the time of picture data transfer and also capable of preventing mal-function due to noise.

Another object of the present invention is to provide a picture data transfer control apparatus allowing such a display apparatus.

According to the present invention, there is provided a display apparatus, comprising: a display panel comprising scanning lines and data lines arranged in a matrix form, and drive means for applying scanning signals and data signals to the scanning lines and data lines, respectively, so as to display a picture on the display panel; said drive means including:

- a plurality of data line drivers disposed so as to apply data signals to the data lines, and
- picture data transfer control means for transferring picture data for one scanning line drive period to the plurality of data line drivers, said picture data transfer control means further including means for supplying a signal for setting a period for intermission of picture data transfer during a period for transferring said picture data for one scanning line drive period to the plurality of data lines.

According to another aspect of the present invention, there is provided a drive control apparatus for a display apparatus of the type comprising a display panel comprising scanning lines and data lines arranged in a matrix form, and drive means for applying scanning signals and data signals to the scanning lines and data lines, respectively, said drive means including a plurality of data line drivers disposed so as to apply data signals to the data lines; said drive control apparatus comprising:

picture data transfer control means for transferring picture data for one scanning line drive period to the plurality of data line drivers, said picture data transfer control means further including means for supplying a signal for setting a period for intermission of picture data transfer during a period for transferring said picture data for one scanning line drive period to the plurality of data lines.

Each of the above-mentioned plurality of data line drivers may be provided with a counter for counting clock signals for transferring data signals and allotted with an individually set counter value, so as to effect a sampling of the picture data based on the counted value of the counter and the set counter value of the data line driver.

Further, each data line driver may be provided with means for self-producing a sampling time signal for sampling picture data based on the set counter value for the data line driver.

Further, each data line may be provided with means for terminating the sampling of the picture data based on the counter value.

Further, each data line driver may be supplied with a signal for each one scanning line drive period from the picture data transfer control means to clear the counted value of the counter.

In the present invention, during a period for transferring picture data for one scanning line drive period to a plurality of data line drivers for supplying data signals to data lines, a signal for setting a transfer period including an intermission period for picture data transfer is inputted, whereby the picture data transfer can be intermitted even in the transfer period so as to reduce the processing load on the picture data transfer control means. Further, the plurality of data line drivers can be connected without resorting to the cascade connection, whereby the occurrence of mal-operation due to electromagnetic interference (EMI) noise may be prevented.

These and other objects, features and advantages of the present invention will become more apparent upon a consideration of the following description of the preferred embodiments of the present invention taken in conjunction with the accompanying drawings.

BRIEF DESCRIPTION OF THE DRAWINGS

FIG. 9 shows a table illustrating an example of the relationship between CID terminals and number of counted clock signals.

DESCRIPTION OF THE PREFERRED EMBODIMENTS

Figure 1:
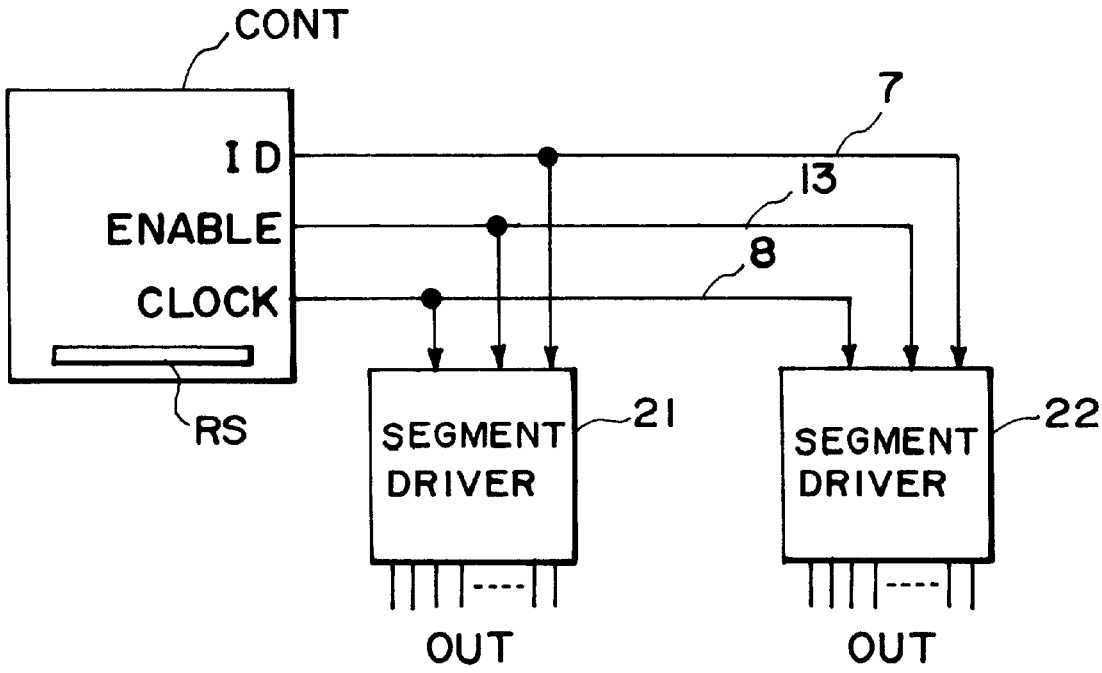
FIG. 1 is a block diagram of an embodiment of the picture data transfer control apparatus according to the invention.

FIG. 1 illustrates an embodiment of the picture data transfer control apparatus according to the present invention.

Referring to FIG. 1, a control apparatus CONT as picture data transfer control means includes therein a register RS for storing generated picture data and also generates and outputs a clock signals, a transfer ENABLE signal and picture data ID.

The picture data ID, the clock signal and the transfer ENABLE signal are transferred via a picture data bus 7, a clock signal line 8 and a transfer enable signal line 13, respectively, and received by drivers 21 and 22, which perform prescribed processing, such as serial-parallel conversion, signal amplification, signal conversion or impedance conversion, on-the received data to issue prescribed signals via output lines OUT.

The output lines OUT may be connected to an electro-optical device, such as a liquid crystal display, a plasma display, an electron discharge device or a light emission device; an electro-thermal conversion device, such as an ink jet head or a thermal head; or an electro-mechanical conversion device, such as a piezoelectric ink jet head, to drive these devices by the drivers 21 and 22 to form a picture.

Figure 2:
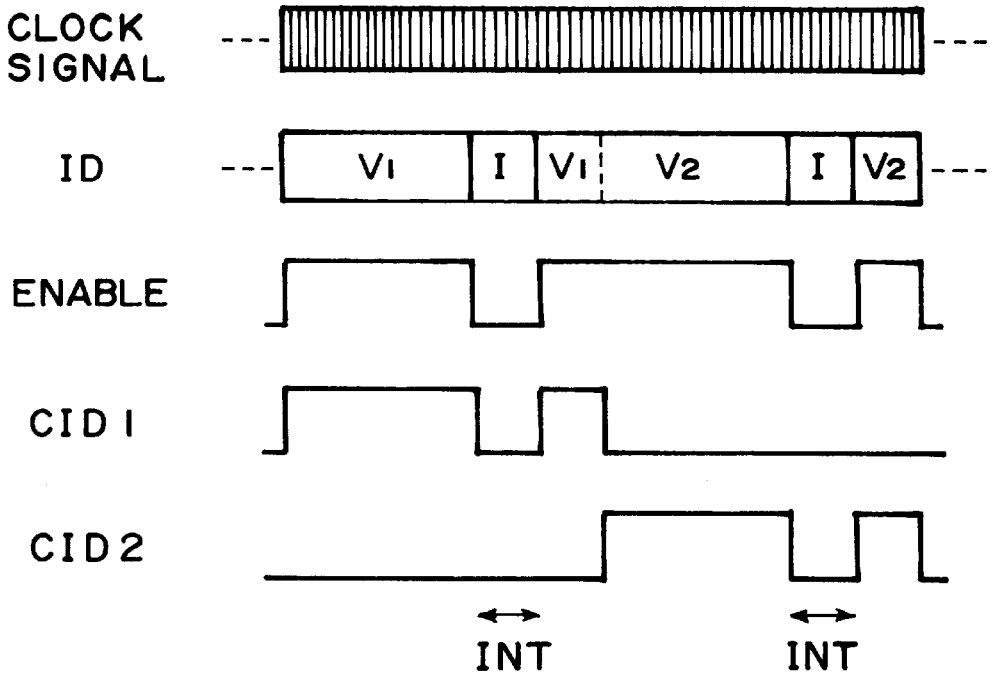
FIGS. 2 and 3 are respectively a time chart for signals used in operation of the apparatus shown in FIG. 1.

FIG. 2 is an embodiment of time chart for various signals used in the picture data transfer control apparatus shown in FIG. 1.

In this embodiment, the drivers 21 and 22 per se are allotted with data for recognizing themselves and, in case where each driver 21 or 22 is supplied with a signal to be inputted thereto, a recognition signal CID1 or CID2 is made "high" so that the picture data is received by the driver 21 or 22.

First, the control circuit CONT enables the transfer enable signal line 13 (i.e., makes the enable signal "high") to send out first picture data V1 to be supplied to the driver 21. At this time, the driver 21 makes the recognition signal CID1 "high" to take in the first picture data V1. On the other hand, the driver 22 does not take in the first picture data since the recognition signal is "low".

In case where the data transfer is desired to be interrupted during transfer of the first picture data for some reason, such as a constraint of the system, the transfer enable signal is disabled (i.e., the enable signal is made "low" to interrupt the transfer of the first picture data V1). An electric signal I on the data bus 7 during the intermission period INT is invalid data. In response to the change of the transfer enable signal from "high" to "low", the driver 21 makes the recognition signal CID1 to be "low" to prevent the taking-in of the invalid data I.

At the time of resumption of data transfer, the control circuit CONT makes the transfer enable signal "HH" and transfers the remainder of the first picture data V1. The driver 21 makes the recognition signal CID1 "high" again to take in the remainder of the first picture data V1. Then, the recognition signal CID1 is made "low" to complete the transfer of the first picture data V1.

Then, the control circuit CONT initiates transfer of second picture data V2 following the first picture data V1. The second picture data V2 should be taken into the driver 22, so that the driver 21 makes the recognition signal CID1 "low" and the driver 22 makes the recognition signal CID2 "high". Thus, the transfer of the second picture data V2 to the driver 22 is initiated. In the same manner as in the case of the intermission of the picture data transfer to the first driver 21, the second driver 22 interrupts the inputting of the second picture data V2 in response to the "low (L)" of the transfer enable signal and resumes the inputting of the second picture data V2 in response to "high (H)" of the transfer enable signal.

In this way, by intermission of picture data transfer depending on the transfer enable signal, it becomes possible to increase the latitude of system designing.

For example, in case where no transfer intermission period INT is provided, the control circuit CONT is required to generate first and second picture data and store the data in the internal register RS, so that the register RS is required to be a register (memory) having a capacity large enough to simultaneously store the first and second picture data V1 and V2.

In contrast thereto, if an organization as illustrated by FIG. 2 is adopted, only a small capacity of register is required so as to store picture data for one driver. For example, the control circuit CONT generates preceding, e.g., three fourths of picture data V1 and stores the data in the register RS and then transfers the data to the driver 21. Then, in the intermission period INT, the control circuit CONT generates the remaining one fourth of the picture data V1 and preceding three fourths of second picture data V2 and stores these data in the emptied register RS. The outputted first picture data V1 and second picture data V2 are inputted to the prescribed drivers 21 and 22, respectively, depending on the recognition signals CID1 and CID2.

Figure 3:
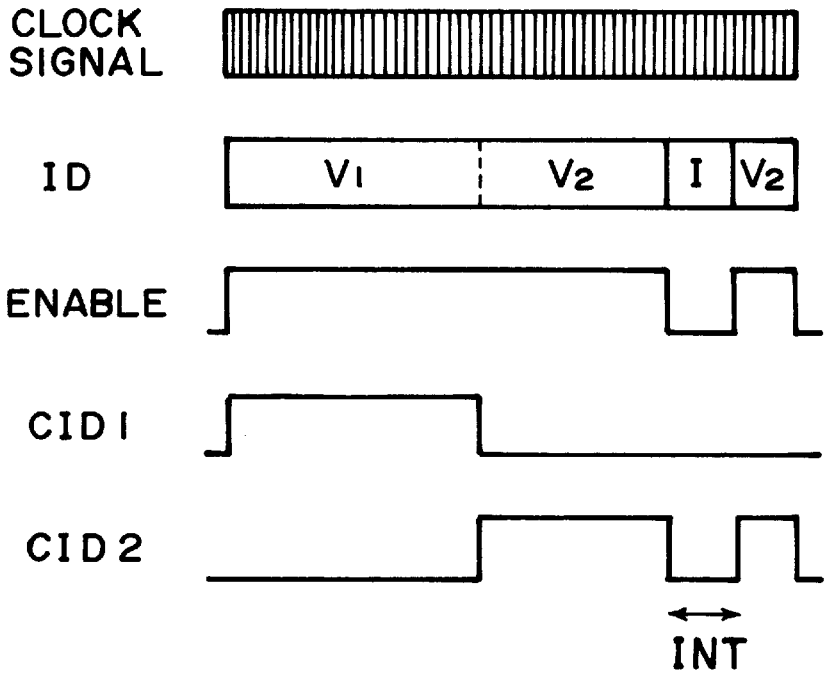

FIG. 3 is another embodiment of time chart for various signals used in the picture data transfer control apparatus shown in FIG. 1.

In this embodiment, no intermission period is involved in a transfer period for first picture data, but data transfer is intermitted in a transfer period for second picture data.

In this case, the register is required to have a capacity for storing, e.g., at least ⅞ of the first and second picture data. This is effective for setting an intermission period INT arbitrarily so as to allow the control circuit CONT to operate another processing when such is required from a viewpoint of system designing rather than for allowing a smaller capacity of register.

Each driver may be composed of a semiconductor integrated circuit chip.

Further, a recognition signal used for determining a time for taking in or sampling picture data into each driver can be produced by the driver per se by counting clock signals. For this purpose, an integrated circuit constituting each driver can be provided with data therein which can be recognized as a circuit pattern, but such data may preferably be supplied from a package board on which the drivers are mounted. Such technique for data supply from a package board is disclosed in detail in EP-A 0740280. If the technique is used, two drivers having an identical structure can be used as drivers 21 and 22, respectively.

Figure 4:
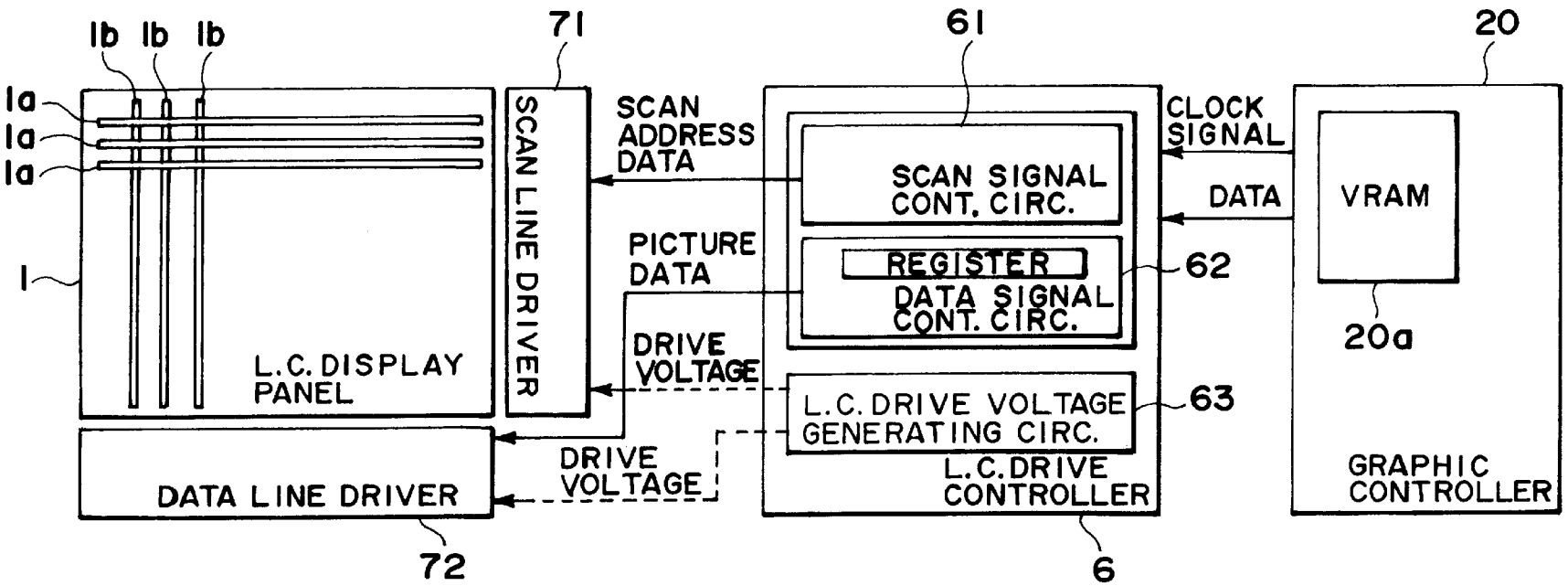
FIG. 4 is a system block diagram of a liquid crystal apparatus according to an embodiment of the invention.

FIG. 4 is a system block diagram of a liquid crystal display apparatus as an embodiment of the display apparatus according to the present invention. Referring to FIG. 4, the display apparatus includes a graphic controller 20 including a VRAM 20*a* for storing picture data, and the picture data (data) in VRAM 20*a* is transferred from the graphic controller 20 to a liquid crystal drive controller 6 according to transfer clock signals.

The data is inputted to a scanning signal control circuit 61 and a data signal control circuit 62 in the liquid crystal drive controller 6 as a picture data transfer control apparatus to be converted into scanning line address data and picture data for data lines, respectively. Thereafter, according to these data, a scanning line drive means 71 and a data line drive means 72 supply a scanning signal waveform and data signal waveforms to scanning lines 1*a* and data lines 1*b* of a liquid crystal panel 1.

The scanning lines 1*a* and the data lines 1*b* of the liquid crystal panel 1 are arranged to form a matrix in combination, and therebetween an electro-optical substance, such as a twisted nematic liquid crystal, a chiral nematic liquid crystal, a ferroelectric liquid crystal or an anti-ferroelectric liquid crystal, is disposed. The scanning line drive means 71 and the data line drive means 72 are supplied with voltages from a liquid crystal drive voltage generation circuit 63.

Figure 5:
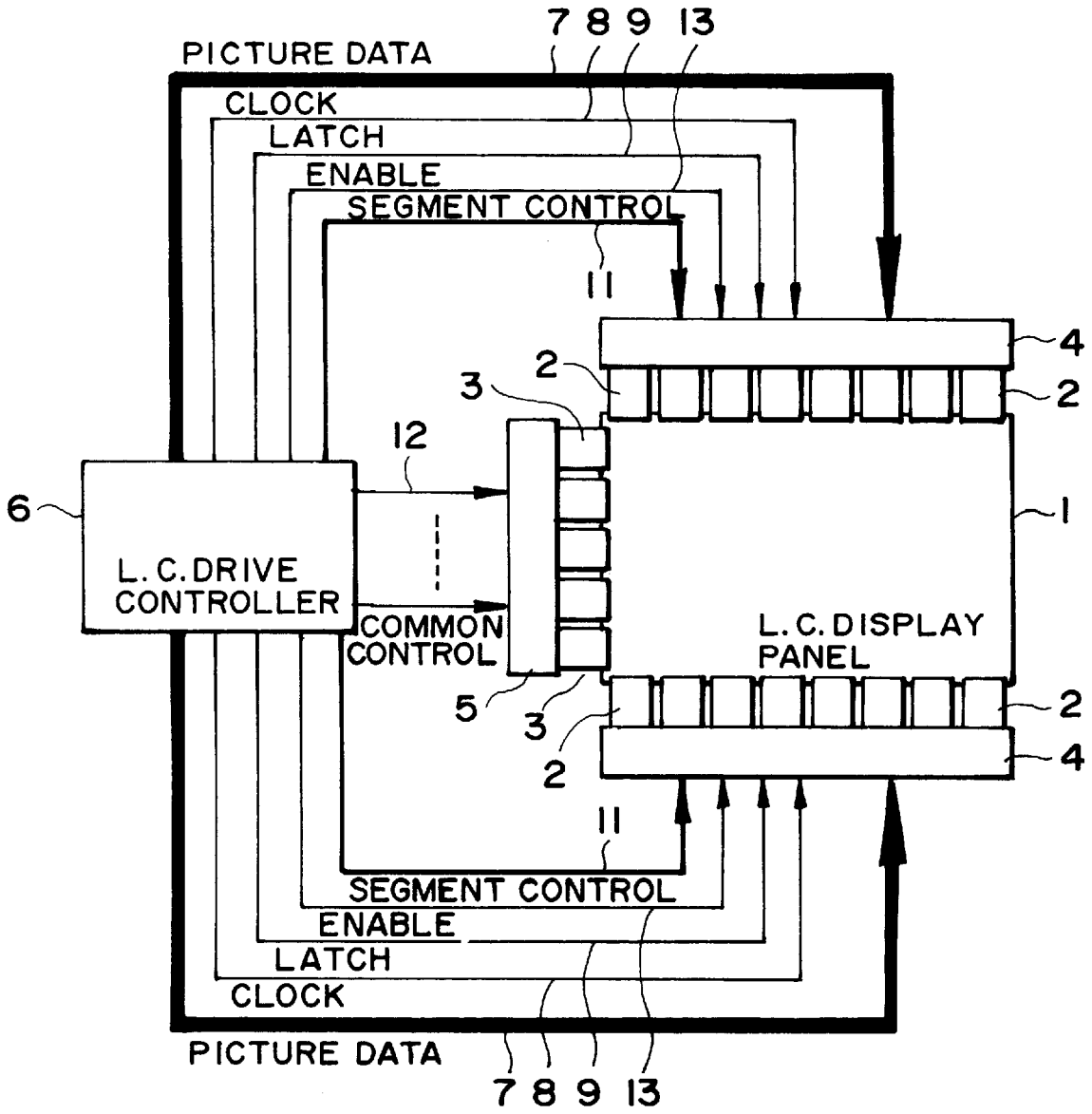
FIG. 5 is a system block diagram for illustrating data transfer between a liquid crystal drive controller and a liquid crystal display panel in the liquid crystal apparatus of FIG. 4.

FIG. 5 is a system block diagram for illustrating a scheme for data transfer between the liquid crystal drive controller 6 and the liquid crystal display panel 1. As shown in FIG. 5, the controller 6 and the panel 1 are connected with a picture data transfer enable signal line 13, through which picture data transfer enable signals (hereinafter referred to as "ENABLE signal(s)") as transfer period-setting signals are inputted in parallel to respective segment drivers 21–23 disposed in parallel and comprising LSIs of identical structure as shown in FIG. 6.

Figure 6:
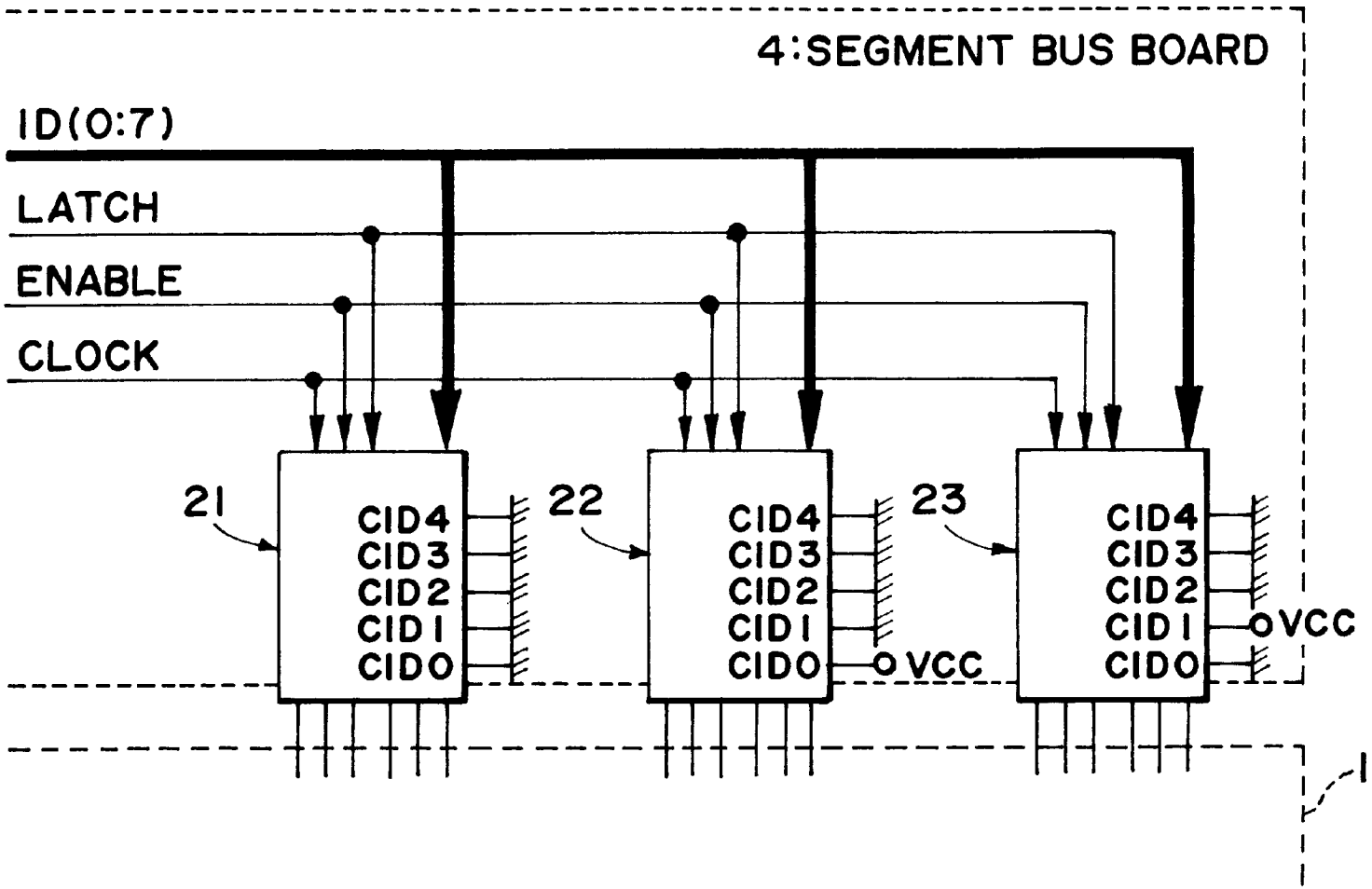
FIG. 6 is a block diagram for illustrating a connection of segment drivers in the liquid crystal apparatus of FIG. 4.

The respective segment drivers 21, 22 and 23 are provided with chip discrimination signals set by pulling terminals CID0–CID4 up to a logic power supply potential VCC or down to the ground potential by a hard pattern formed on a segment bus board 4 as shown in FIG. 6.

Picture data (ID0–ID7) transferred to the respective segment drivers 21–23 respectively comprise 8 bit width, and data for all the drivers are serially transferred so that transfer of picture data is started when the ENABLE signal is high "H". During the period of "H", the respective segment drivers 21–23 count the clock signals by a data sampling counter 2B shown in FIG. 8.

Further, each of the segment drivers 21–23 is provided with a decoder 2C for decoding a chip discrimination number allotted thereto into a corresponding number of counted clock signals. FIG. 9 is an example of table showing a relationship between states of CID0–CID4 terminals and numbers of counted clock signals. In this example, the presence of 5 terminals allows discrimination of 32 drivers. In FIG. 9, "0" represents a pull-down state and "1" represents a pull-up state. For example, a counter 2B of a driver having terminals CID0–CID4 all in the pull-down state is instructed by its decoder 2C to count 1st to 20th clock signals and, during the counting, a corresponding CID-EN1 signal is made high "H".

Figure 8:
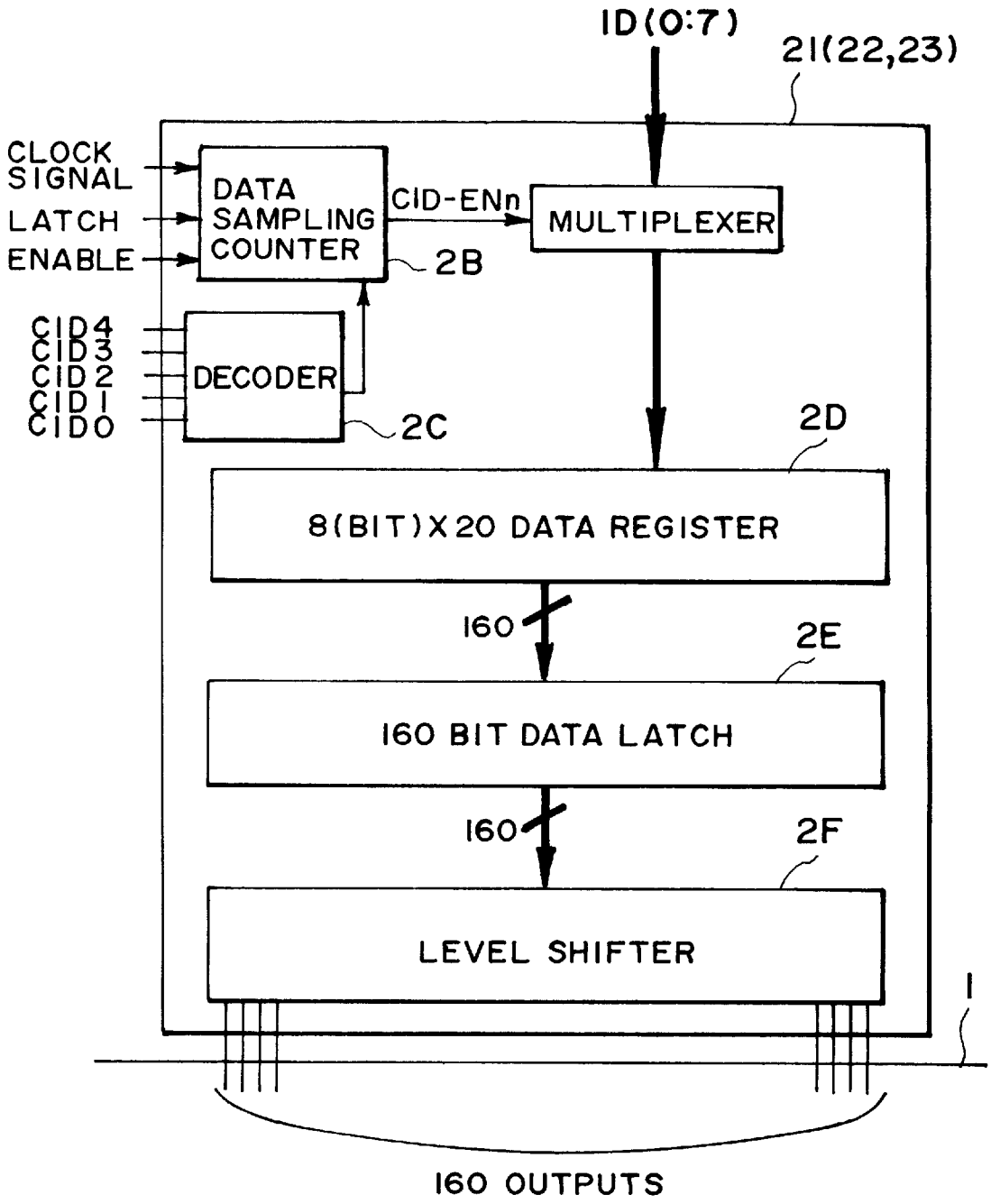
FIG. 8 is a block diagram illustrating an internal organization of a segment driver of FIG. 6.

On the other hand, as shown in FIG. 8, each driver includes a data register 2D for storing 20 picture data each having 8 bit width, i.e., 160 bit picture data, a data latch 2E for latching the 160 bit picture data stored in the data register 2D based on a LATCH signal inputted for each one scanning line drive period, and a level shifter 2E for level-shifting the data latched by the data latch 2E to a voltage for panel drive.

Figure 7:
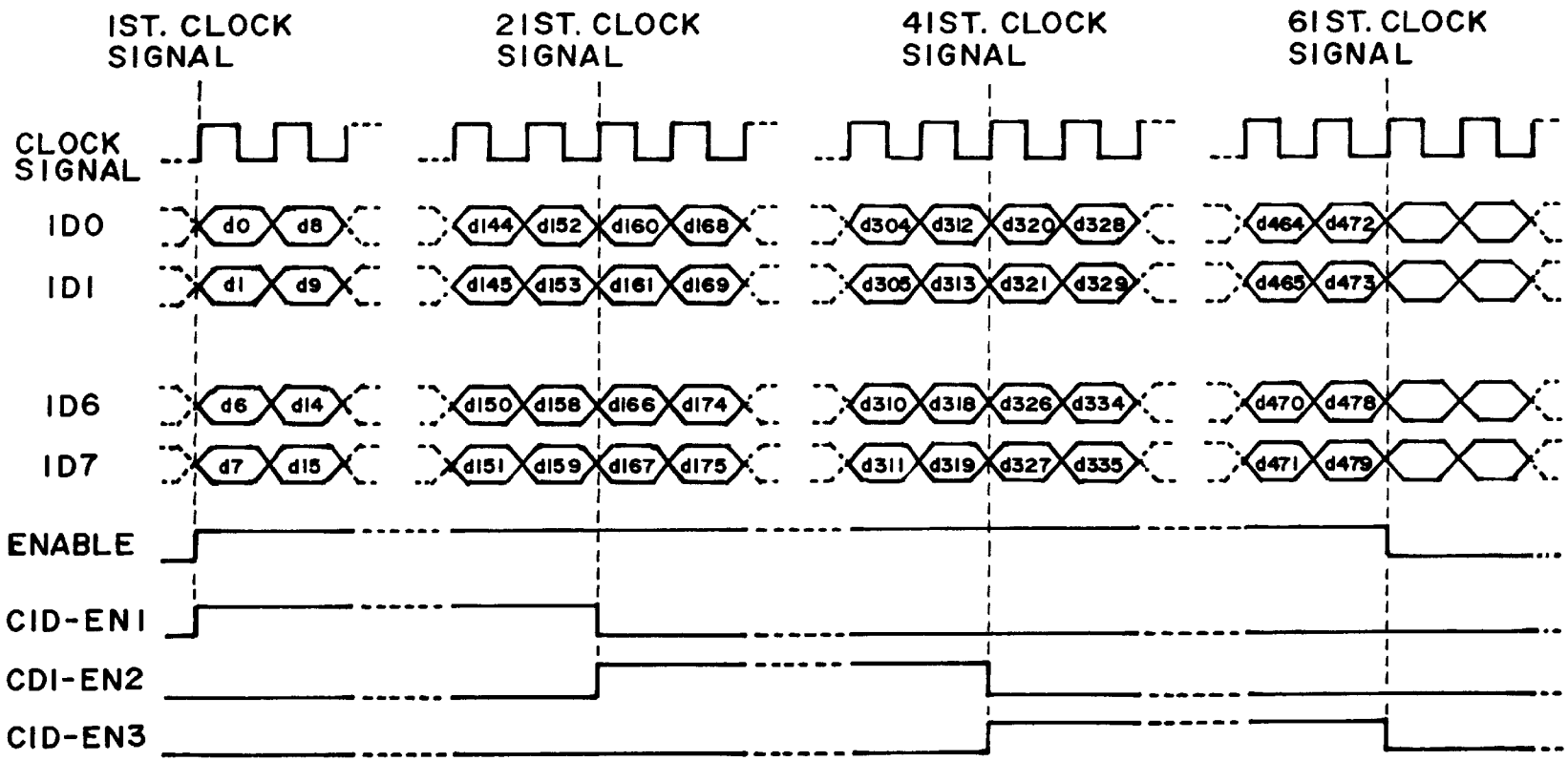
FIG. 7 is a time chart for a data transfer scheme for the liquid crystal apparatus of FIG. 4.

As briefly mentioned above, when the number of counted clock signals reaches a prescribed ordinal number, each segment driver (21, 22 or 23) self-produces a CID-ENn which is a signal for determining the time for sampling picture data ID (0:7) to be "H", such as ICD-EN1 self-produced at a first clock pulse by the first segment driver 21, CID-EN2 self-produced at a 21st clock pulse by the second segment driver 22, and CID-EN3 self-produced at a 41st clock pulse by the third segment driver 23, as shown in FIG. 7.

Accordingly, picture data supplied synchronously with the first clock signal is started to be sampled by the first segment driver 21, picture data supplied synchronously with the 21st clock signal is started to be sampled by the second segment driver 22; and picture data supplied synchronously with the 41st clock signal is started to be sampled by the third segment driver 23.

In this embodiment, as each segment driver (21, 22 or 23) has, e.g., 160 output pins, a sampling of picture data for one segment driver among picture data for one scanning line driver period is completed when 160 bit picture data is sampled, i.e., 8 bit picture data is sampled for 20 clock signals.

Accordingly, each data sampling counter terminates its operation when 20 clock signals are counted since the point when CID-ENn is made "H", and then changes CID-ENn to low "L", thereby complete the sampling of picture data for the segment driver.

Figure 19:
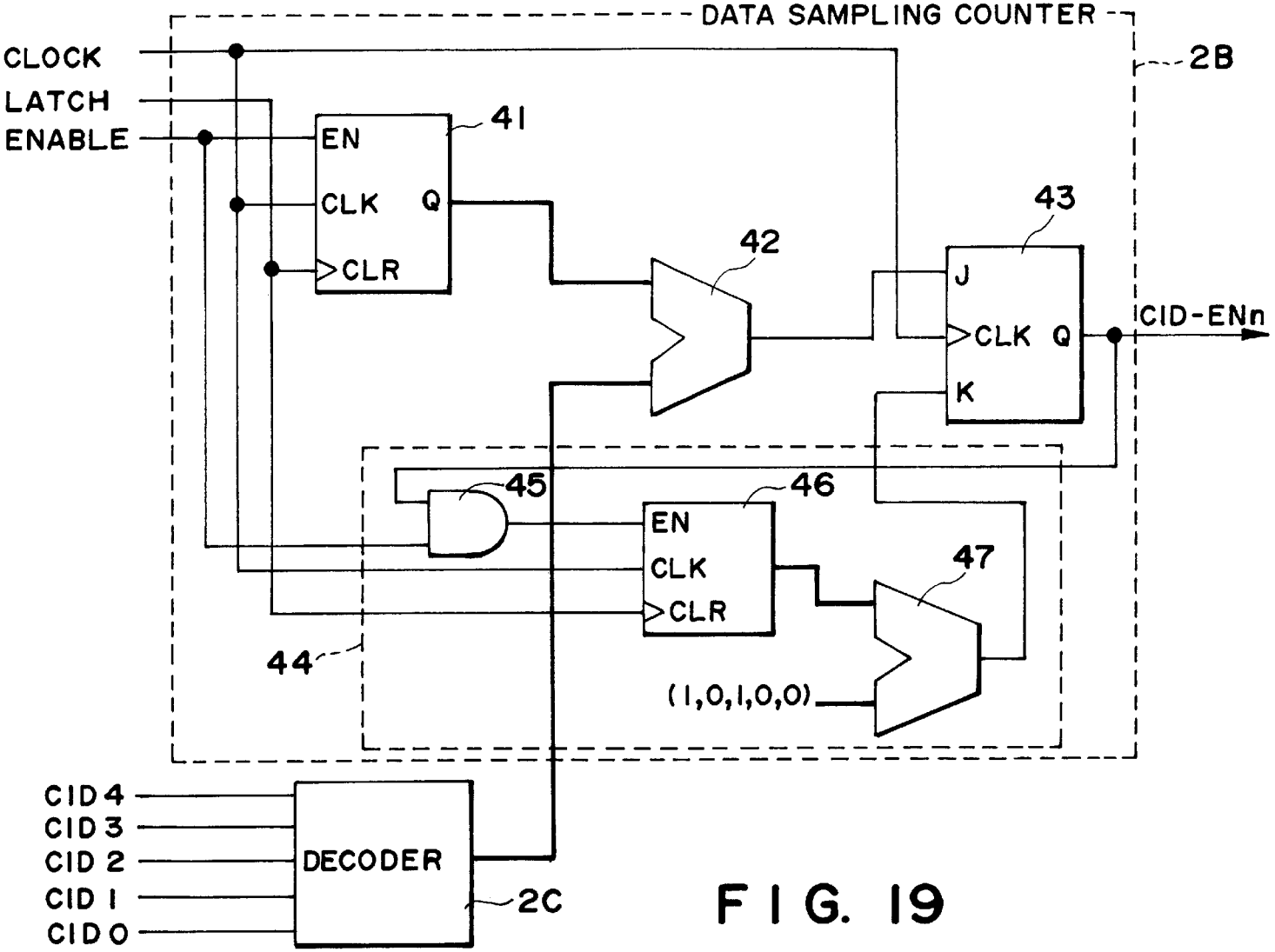
FIG. 19 is a block diagram illustrating an internal organization of the data sampling counter shown in FIG. 8.

FIG. 19 is a block diagram for illustrating an internal organization of the data sampling counter 2B shown in FIG. 8.

Referring to FIG. 19, the data sampling counter 2B includes a 10 bit-counter 41. In order to taken in picture data outputted to 160 data electrodes for each driver from an 8 bit-bus, 20 counts are required. Accordingly, in order to discriminate the chip address of 32 drivers, the counter 41 has to effect 20×32=640 counts (>512=$2^9$) nd is constituted as a 10 bit-counter.

An output from the 10 bit-counter 41 is compared with the output of the decoder 2C by a comparator 42. For example, in the case of a driver for taking in picture data for 1st to 20th clock signals among the total picture data, the output of the counter 41 is compared with the output of the decoder 2C, i.e., a counter value individually set to the driver, whereby, from the start of the 1st clock signal, the comparator 42 supplies a high-level input signal to a J-terminal of a latch 43 comprising a flip-flop. As a result, a high-level chip enable signal CID-ENn for sampling picture data is outputted from a Q-terminal of the latch 43.

The data sampling counter 2B further includes a circuit 44 for terminating the sampling of picture data including an AND gate 45, a 5 bit-counter 46 and a comparator 47. On receiving an output from the AND gate 45, the 5 bit-counter 46 effects the counting of the output of the AND gate 45 and outputs the result to the comparator 47. To the other input terminal of the comparator 47, data (1, 0, 1, 0, 0) corresponding to 20 counts is input so that, when the counted value from the 5-bit-counter 46 reaches 20, the comparator inputs the result to a K-terminal of the latch 43, thereby changing the output of the Q-terminal to a low level.

For each transfer of picture data for one scanning line, a low level signal is inputted through a latch signal terminal LATCH to the counters 41 and 46, whereby the counted values in the counts 41 and 46 are cleared, and the above-described operation is repeated.

As shown in FIG. 8, the sampled picture data obtained through the above-described operation is stored in the data register 2D in the segment driver and latched into the data latch 2D according to a LATCH signal inputted for each one scanning line drive period. Thereafter, the picture data latched in the data latch 2D is level-shifted by the level shifter 2F in the segment driver to drive voltage signals, which are simultaneously or sequentially supplied to an array of pixels on a selected scanning line.

In this embodiment, the LATCH signal is used as a clear or reset signal so that the counted number in the data sampling counter is cleared by the LATCH signal as described with reference to FIG. 19, whereby picture data for a subsequently driven scanning line can be properly sampled.

In this embodiment, an intermission period is designed to be provided as desired during data transfer for one scanning line drive period so as to alleviate a processing load on the liquid crystal drive controller 6 during picture data transfer.

Figure 10:
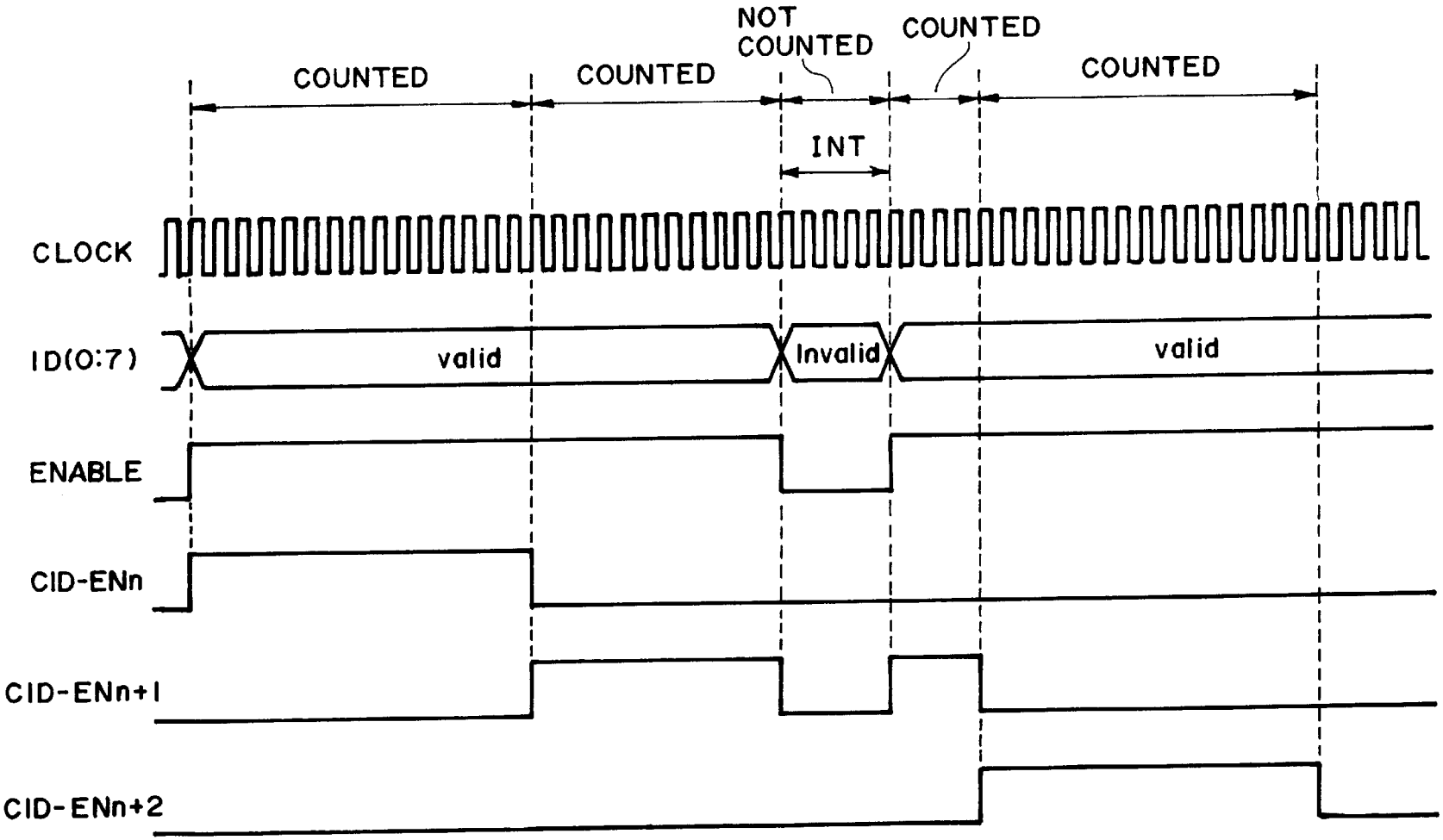
FIGS. 10 and 11 are respectively a time chart for providing an intermission period during a data transfer period for operation of the liquid crystal apparatus of FIG. 4.
Figure 11:
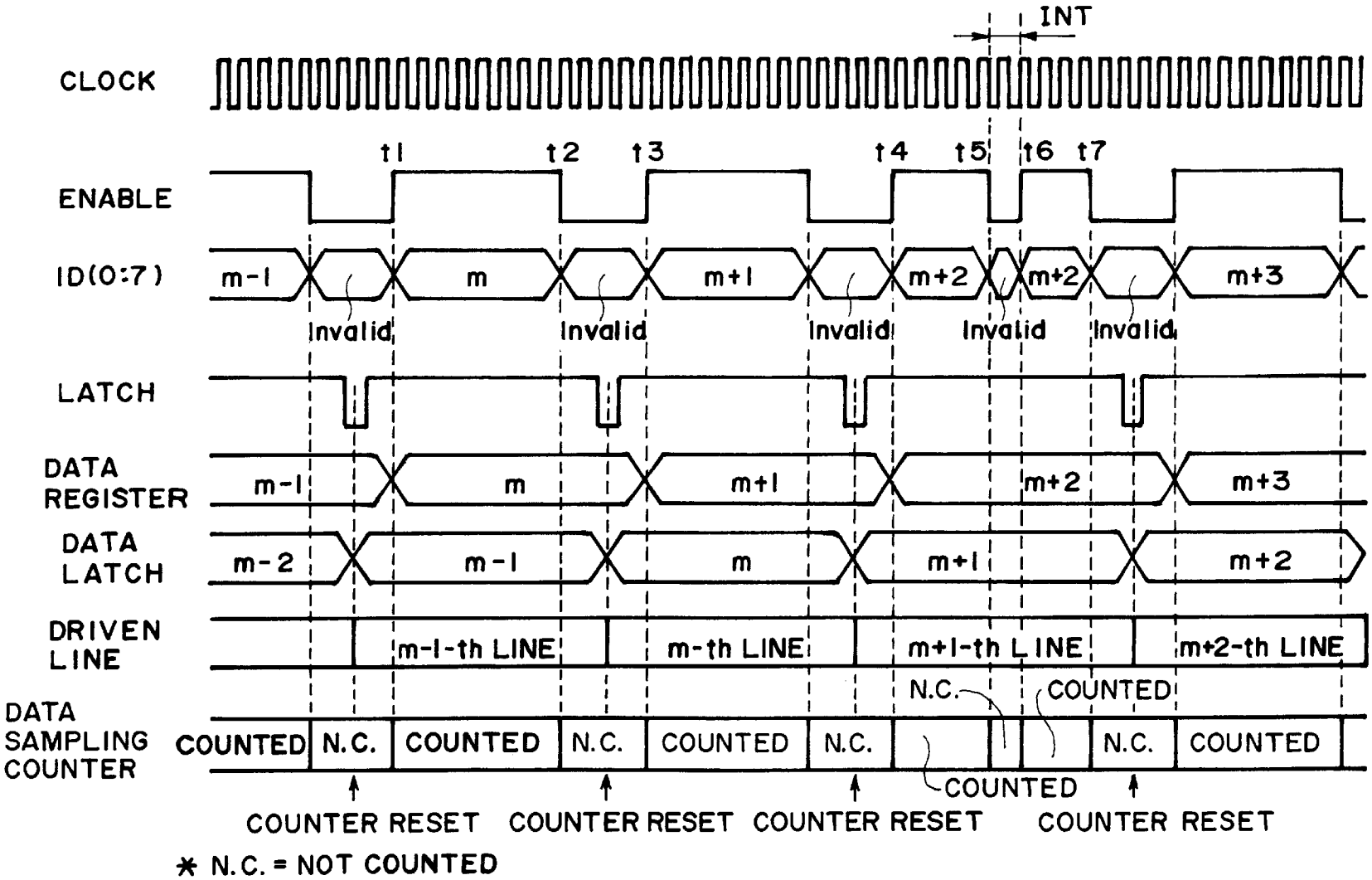

FIGS. 10 and 11 are time charts for a case including such an intermission period, whereas the number of clock signals shown in these figures does not represent an accurate time relation. In FIG. 11, m represents an m-th scanning line on a panel. As shown in FIG. 11, picture data is continuously transferred for each one scanning line drive period for, e.g., m-th, m+1-th, and m+3-th scanning lines, but an intermission period INT is provided during transfer of picture data for an m+2-th scanning line and, during the intermission period INT, the data transfer is intermitted. The intermission period INT is formed by setting "L" during a period of normally "H" of an ENABLE signal as shown in FIG. 10 by the liquid crystal drive controller 6.

The manner of sampling picture data provided with such an intermission period INT is similar to that explained in the above-described basic operation. Thus, a data sampling counter in each segment driver 21, 22 or 23 is designed to count the number of clock signals according to a chip discrimination number allotted thereto as described above.

In a picture data transfer intermission period INT, however, the liquid crystal drive controller 6 sets the ENABLE signal to be "L" as shown in FIG. 10, whereby the data sampling counter 2B in the segment driver 21, 22 or 23 is prevented from counting inputted clock signals. The data sampling counter 2B is designed to set a CID-EN signal to be "L" in the period of the ENABLE signal being "L", whereby the sampling of picture data is not performed in the intermission period INT.

Now, the operation is briefly described in time series while referring to FIG. 11. At time "t1", the ENABLE signal is made "H", picture data to be supplied to pixels on an m-th scanning line is taken in a first driver in an array of drivers and started to be stored in a data register 2D therein. At this time, a data latch 2E is outputting picture data to be supplied to pixels in a previously selected m−1-th scanning line, thereby determining the display states of pixels on the m−1-th scanning line (Drive on m−1-th line). At time "t2" when the transfer ENABLE signal is made "L", picture data transfer to the last driver is completed.

During a period between time t2 and t3, processing including generation of picture data, storing of picture data in a register, etc., is performed at a high speed in the controller 6, and the data transfer to the drivers is made "invalid". However, in the drivers, the storing in the data register, data latching, line drive, etc., are continually performed. During this period, when the latch signal is made low, the objective data for the data latching and line drive is switched to picture data for an m-th scanning line.

During a period between time t3 to t4, the above-mentioned operation is repeated.

When the transfer is to be intermitted for allowing a processing other than picture data transfer of the controller 6, the ENABLE signal is made "L" at time t5. At this time, signals on the data bus are invalid, so that the signal CID-ENn+1 is made "L" and a driver generating the signal CID-ENn+1 does not sample the data on the data bus. At this time, however, the driver performs therein the latching and supplying to the liquid crystal panel (line drive) of the picture data for the m+1-th line.

At time t6 when the intermission period is terminated, the controller 6 resumes an effective transfer of picture data for the m+2-th line. At this time, the ENABLE signal is made "H", a driver allowed to generate the signal CID-ENn+1 makes the signal CID-ENn+1 "H" to resume sampling of picture data. In this instance, one line drive period is set to be longer as a margin than a period for sampling one-line picture data, so that the one line drive period is prevented from being exceptionally longer even if the intermission period is present, as a matter of designing.

At time t7, the ENABLE signal is made "L", the picture data transfer for the m+2-th time is completed.

As described above, by providing an intermission period INT in a data transfer period for transferring one scanning line drive data and not sampling picture data during the intermission period INT, the processing load on the liquid crystal drive controller 6 can be alleviated. Further, as the cascade connection between the segment driver becomes unnecessary, the concern with mal-operation due to noise can be removed.

Next, another embodiment of the present invention will be described.

Figure 12:
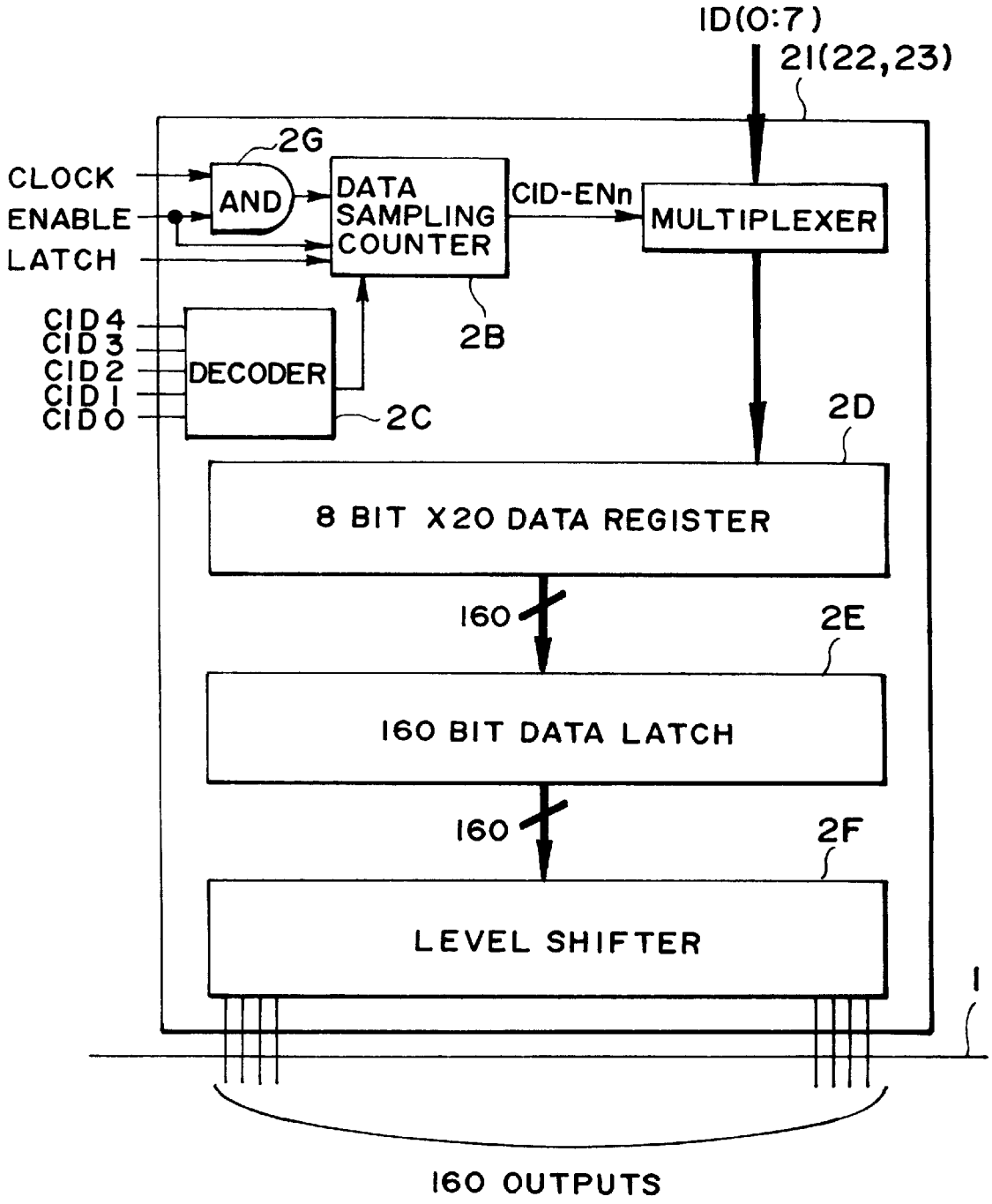
FIG. 12 is a block diagram showing another internal organization of a segment driver in the liquid crystal apparatus.
Figure 13:
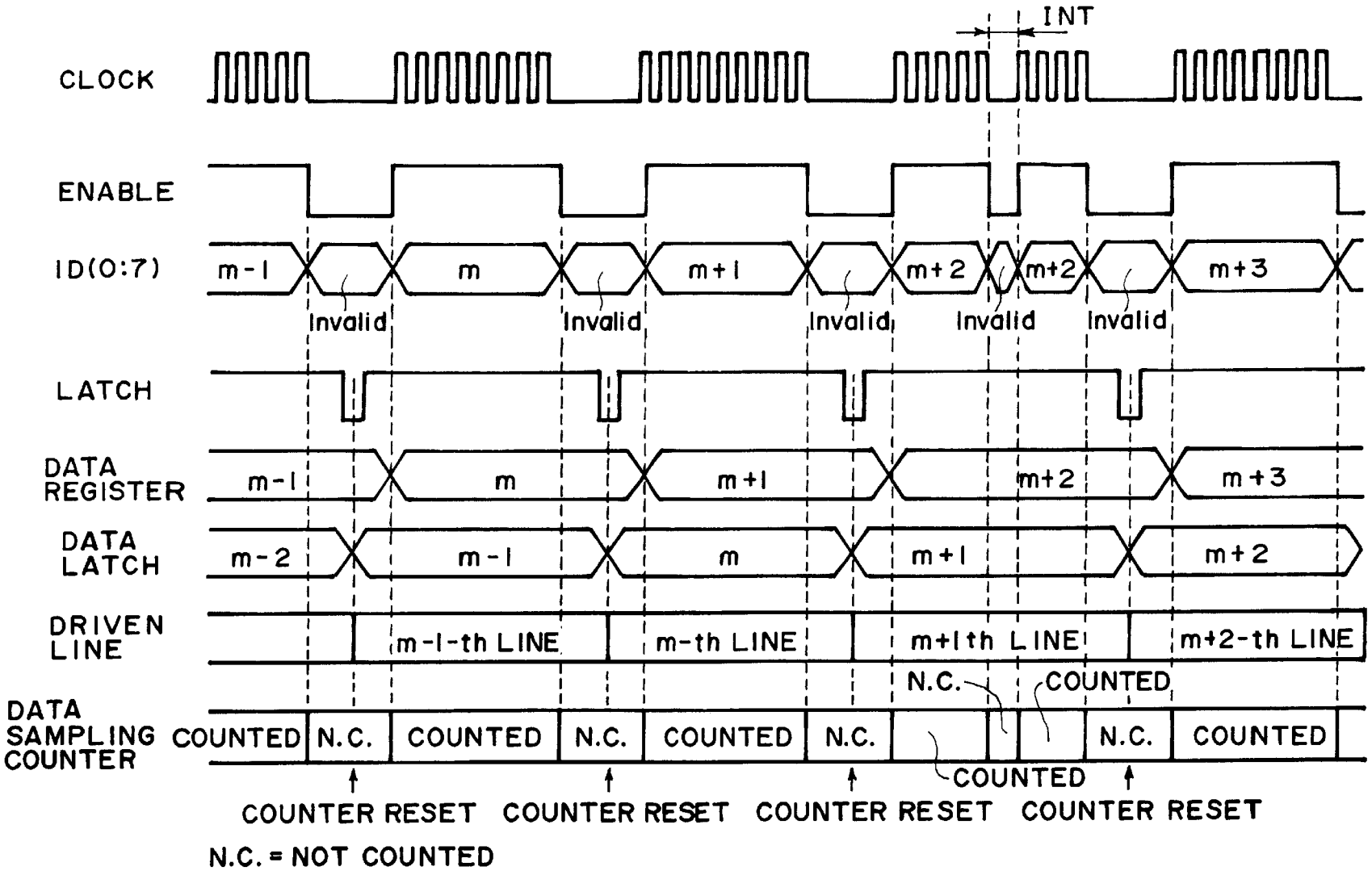
FIGS. 13 and 14 are time charts each showing another embodiment of data transfer according to the invention.

FIG. 12 is a block diagram illustrating an organization of a segment driver for a liquid crystal apparatus according to this embodiment. In this figure, the same numerals as in FIG. 8 represent identical or corresponding parts.

Referring to FIG. 12, the segment driver includes an AND gate 2G disposed in precedence to a data sampling counter 2B so as to take an AND of a clock signal and an ENABLE signal. By providing such an AND gate 2G, clock signals are not inputted to or counted by the data sampling counter 2B during a period of the ENABLE signal being "L", i.e., in the intermission period for picture data transfer. As a result, it becomes unnecessary to add a circuit required so as not to count the clock signals at the time of the ENABLE signal "L" in the data sampling counter 2B.

Thus, as the number of counted clock signals is not changed during the period of the ENABLE signal "L", it becomes possible to provide an intermission period within a period for transferring one-scanning line drive period data. Also according to this embodiment, the cascade connection between the segment driver becomes unnecessary so that the concern with mal-operation due to noise can be removed.

Next, still another embodiment of the present invention will be described.

In this embodiment, an AND gate 2G shown in FIG. 12 is provided not in each segment driver but in a liquid crystal drive controller 6 identical to the one shown in FIG. 5. As a result of this organization, clock signals are not inputted to a segment driver or counted during a period of the ENABLE signal "L", i.e., in an intermission period for picture data transfer for an m+2-th line. As a result, it becomes unnecessary to add a circuit required for not counting the clock signals in each data sampling counter.

Further, as the clock signals are not counted in the period of the ENABLE signal "L", it becomes possible to provide an intermission period within a period for one-scanning line drive period data. Further, as the cascade connection between segment drivers is not necessary, the concern with mal-operation due to noise can be removed.

As described above, according to each embodiment described above, by providing an intermission period for picture data transfer during a period for transferring picture data for one-scanning line drive period, it becomes possible to alleviate the processing load on the side of picture data transfer control means. Further, as the cascade connection between segment drivers can be omitted, it becomes possible to alleviate the occurrence of mal-operation due to EMI.

A further embodiment of the present invention will now be described.

Figure 14:
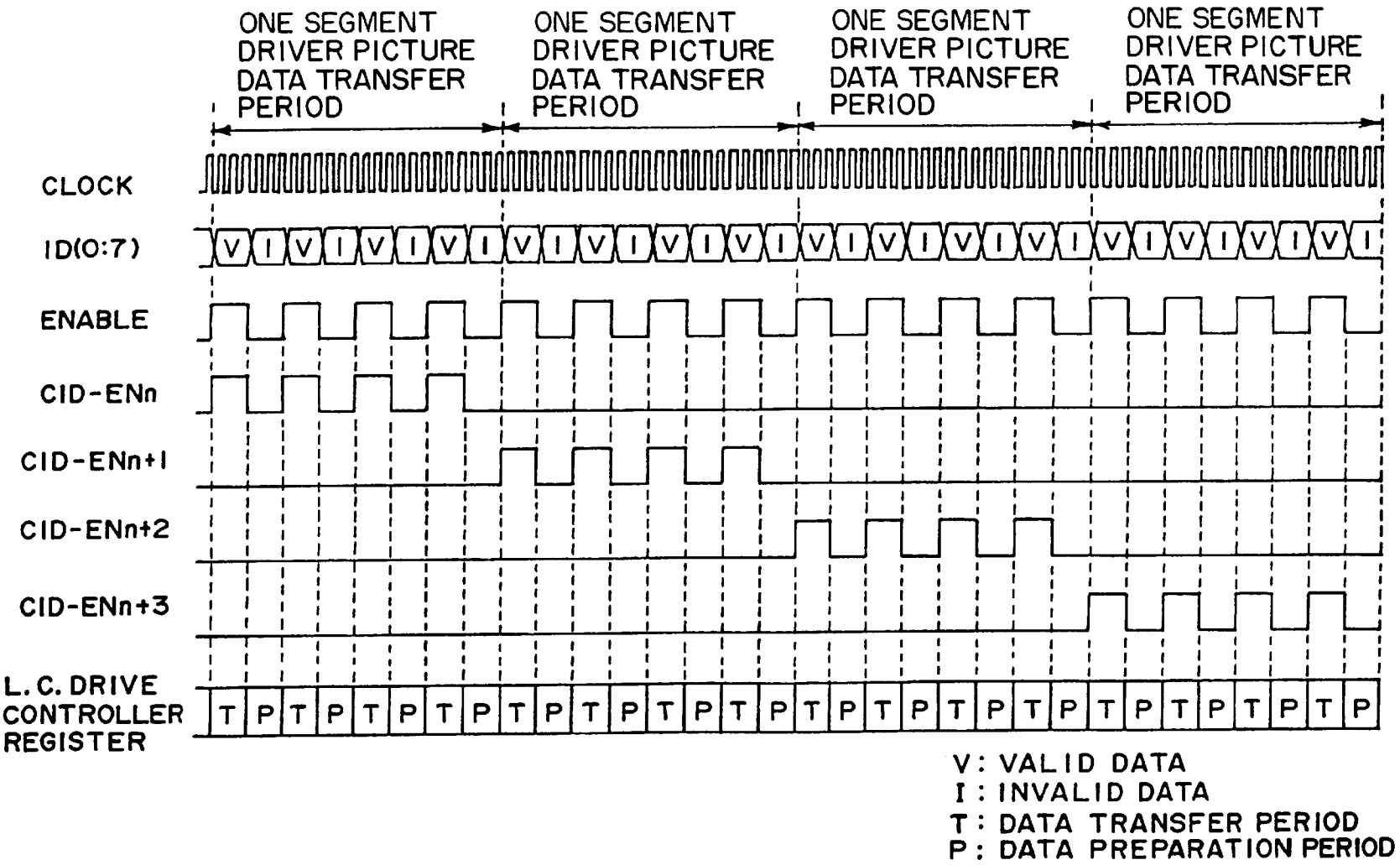
Figure 15:
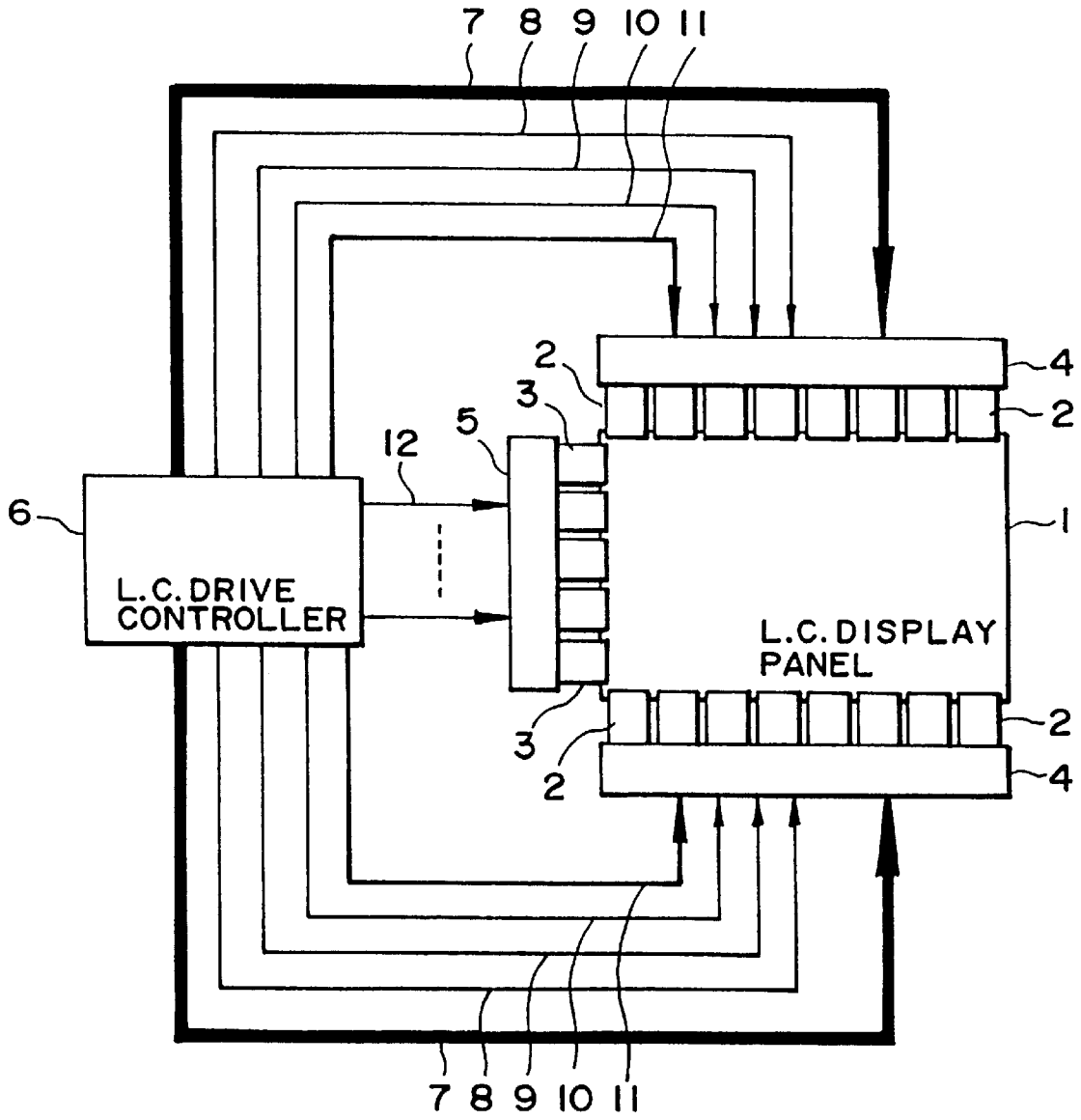
FIG. 15 PRIOR ART
FIG. 15 is a system block diagram for illustrating a data transfer scheme in a conventional liquid crystal apparatus.
Figure 16:
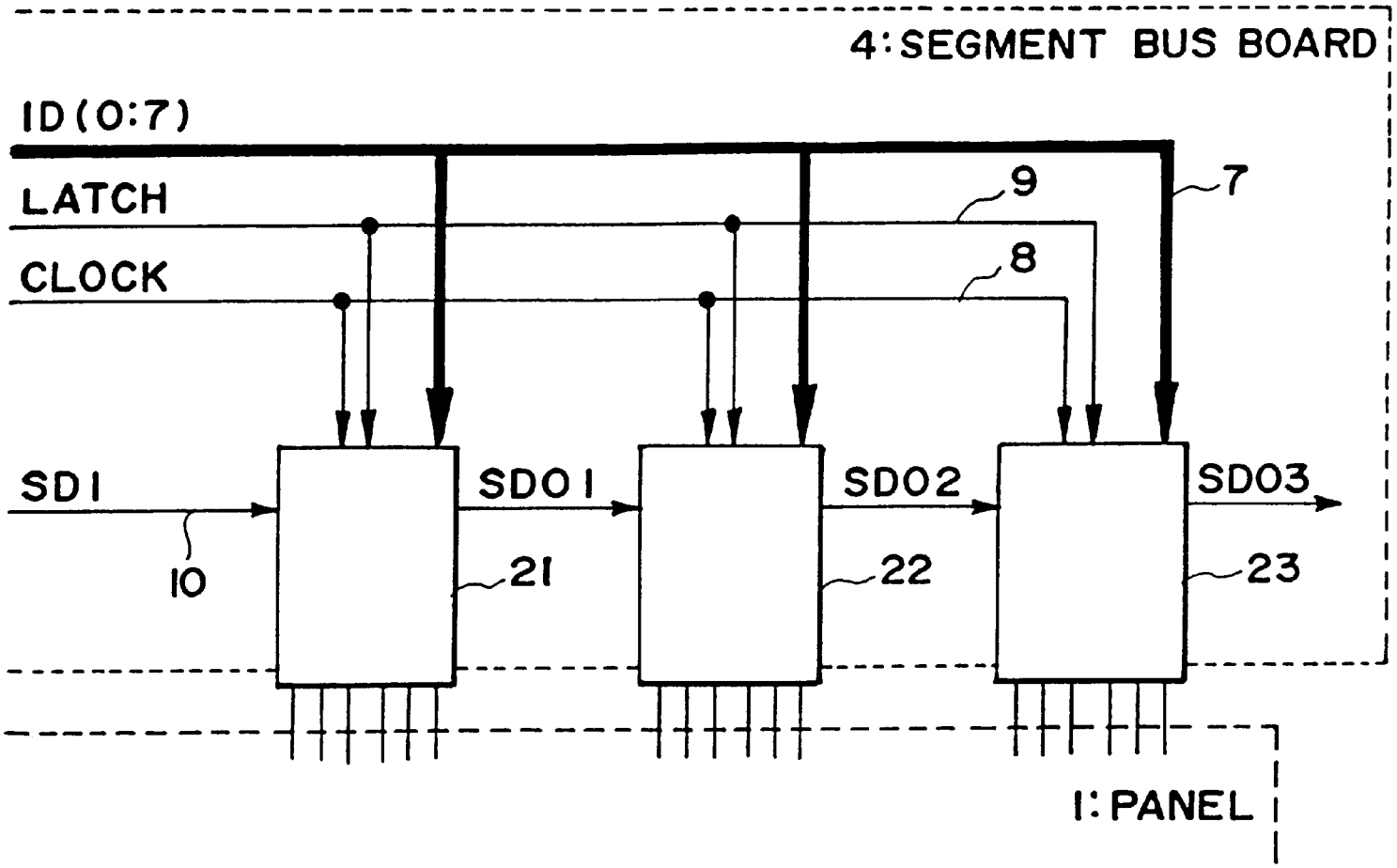
FIG. 16 PRIOR ART
FIG. 16 is a block diagram illustrating a manner of connection of segment drivers in the liquid crystal apparatus of FIG. 15.
Figure 17:
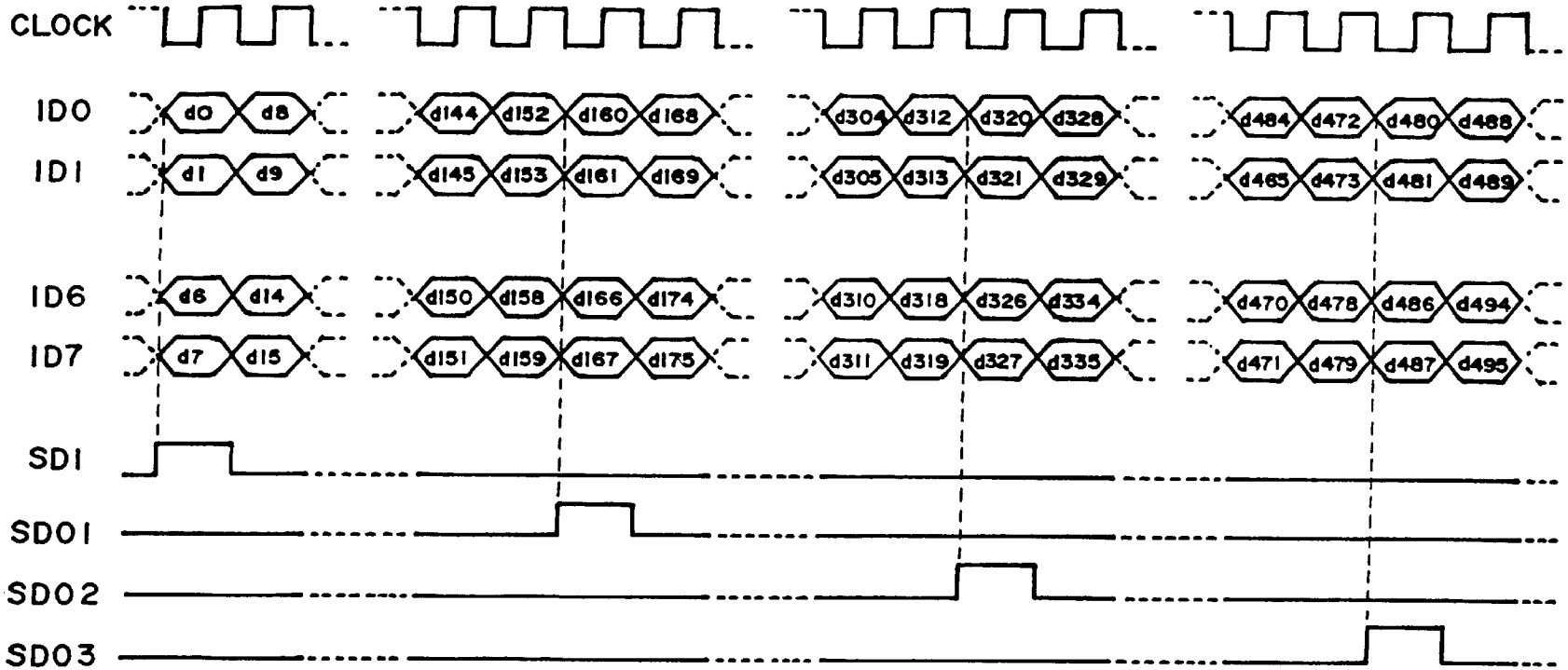
FIG. 17 PRIOR ART
FIG. 17 is a time chart illustrating a manner of data transfer in the liquid crystal apparatus of FIG. 15.
Figure 18:
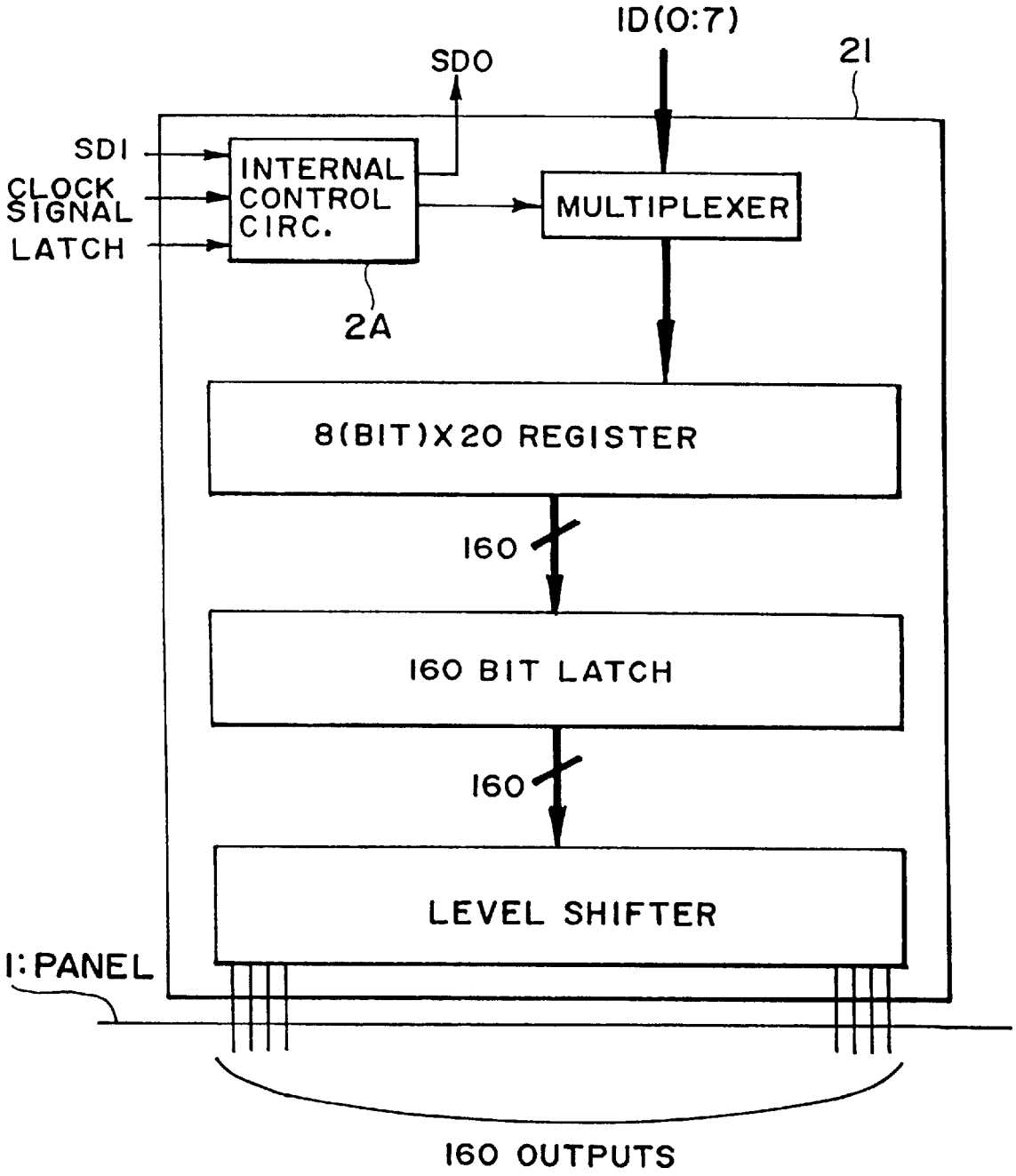
FIG. 18 PRIOR ART
FIG. 18 is a block diagram illustrating an internal organization of a segment driver for performing a conventional data transfer scheme.

In this embodiment, a 40-bit register is adopted in a liquid crystal drive controller. The control is performed in a picture data transfer time sequence as shown in FIG. 14 (wherein the number of clock signals does not represent an accurate time relation). According to this embodiment, it becomes unnecessary to provide a register covering a total number of bits for one scanning line in a liquid crystal drive controller as a picture data transfer control means.

More specifically, an ENABLe signal "L" shown in FIG. 4, i.e., a picture data transfer intermission period of the present invention is used as a period for preparing for picture data transfer in the liquid crystal drive controller, i.e., for receiving picture data to be transferred next from a VRAM 20*a* and setting the data in the register. In FIG. 14, V represents valid data, I represents invalid data, T represents a picture data transfer period, and P represents a period for preparing picture data.

Referring to FIG. 14, in this embodiment, a period for picture data transfer to one segment driver is divided into four periods so that, if one segment driver has 160 output pins, it is necessary to provide a register having only one fourth thereof, i.e., 40 bits, in a liquid crystal drive controller. Thus, the circuit size of the liquid crystal drive controller can be reduced.

During each data preparation period, rewriting of new data into a register is performed.

In this embodiment of FIG. 14, the period for picture data transfer to one segment driver is divided into four periods as described above but the number of such division may be any arbitrary number, such as 2, 8, or 16.

The transfer time scheduling in this embodiment can be applied to any preceding embodiment.

As described above, according to the present invention, by providing an intermission period for picture data transfer during a period for transferring picture data for one-scanning line drive period, it becomes possible to reduce the processing load on the side of the picture data transfer control means. Further, as the cascade connection can be omitted, it becomes possible to alleviate the occurrence of malfunction due to noise.

What is claimed is:

1. A display apparatus, comprising:

a display panel comprising scanning lines and data lines arranged in a matrix form, and drive means for applying scanning signals and data signals to the scanning lines and data lines, respectively, so as to display a picture on the display panel; said drive means including:

a plurality of data line drivers disposed so as to apply data signals to the data lines, and picture data transfer control means for transferring picture data for one scanning line drive period to the plurality of data line drivers, said picture data transfer control means further including means for supplying a signal for setting a period for intermission of picture data transfer during a period for transferring the picture data for one scanning line drive period to at least one of the plurality of data line drivers, wherein the period for intermission of picture data transfer being set within a period for picture data transfer to each of the plurality of data line drivers.

2. A display apparatus according to claim 1, wherein each of said plurality of data line drivers is provided with a counter for counting clock signals for transferring data signals and allotted with an individually set counter value, so as to effect a sampling of the picture data based on the counted value of the counter and the set counter value of the data line driver.

3. A display apparatus according to claim 2, wherein each data line driver is provided with means for self-producing a sampling time signal for sampling picture data based on the set counter value for the data line driver.

4. A display apparatus according to claim 2, wherein each data line driver is provided with means for terminating the sampling of the picture data based on the counter value.

5. A display apparatus according to claim 2, wherein each data line driver is supplied with a signal for each one scanning line drive period from the picture data transfer control means to clear the counted value of the counter.

6. A display apparatus according to claim 1, wherein said means for supplying a signal for setting a period for intermission of picture data transfer includes a common line for supplying the signal to the plurality of data line drivers.

7. A drive control apparatus for a display apparatus of the type comprising a display panel comprising scanning lines and data lines arranged in a matrix form, and drive means for applying scanning signals and data signals to the scanning lines and data lines, respectively, said drive means including a plurality of data line drivers disposed so as to apply data signals to the data lines; said drive control apparatus comprising:

picture data transfer control means for transferring picture data for one scanning line drive period to the plurality of data line drivers, said picture data transfer control means further including means for supplying a signal for setting a period for intermission of picture data transfer during a period for transferring said picture data for one scanning line period to at least one of the plurality of data line drivers, wherein the period for intermission of picture data transfer being set within a period for picture data transfer to each of the plurality of data line drivers.

8. A drive control apparatus according to claim 7, wherein said means for supplying a signal for setting a period for intermission of picture data transfer includes a common line for supplying the signal to the plurality of data line drivers.

9. An apparatus for controlling picture data transfer, comprising:

a plurality of data line drivers for outputting signals corresponding to picture data; and picture data transfer control means for transferring the picture data to said plurality of data line drivers, said picture data transfer control means including means for applying a signal for setting an intermission period for the picture data transfer during a unit period for transferring picture data to all said data line drivers, wherein the signal for setting an intermission period for the picture data transfer is applied to at least one of the plurality of data line drivers during a sub-unit period for transferring picture data to each of the plurality of data line drivers, wherein the period for intermission of picture data transfer being set within a period for picture data transfer to each of the plurality of data line drivers.

10. An apparatus according to claim 9, wherein said drivers are provided in a number of A and the intermission period is provided in a number of B satisfying $B<A$.

11. An apparatus according to claim 9, wherein said drivers are provided in a number of A, and the intermission period is provided in a number of B satisfying $B=nA$, wherein n is a natural number.

12. An apparatus according to claim 9, wherein said picture data transfer control means includes a register for storing picture data having a capacity which is smaller than that of a register capable of storing picture data for all of said drivers.

13. An apparatus according to claim 9, wherein said picture data transfer means includes a register for storing picture data having a capacity which is smaller than that of a register capable of storing picture data for one of the plurality of said drivers.

14. An apparatus according to claim 9, wherein said means for supplying a signal for setting an intermission period for the picture data transfer includes a common line for supplying the signal to the plurality of data line drivers.

* * * * *

UNITED STATES PATENT AND TRADEMARK OFFICE

CERTIFICATE OF CORRECTION

PATENT NO. : 6,232,940 B1
DATED : May 15, 2001
INVENTOR(S) : Tomoyuki Ohno et al.

It is certified that error appears in the above-identified patent and that said Letters Patent is hereby corrected as shown below:

Column 4,
Line 39, "signals" should read -- signal --.
Line 47, "on-the" should read -- on the --.

Column 7,
Line 50, "taken" should read -- take --.

Signed and Sealed this

Twenty-sixth Day of March, 2002

*Attest:*

*Attesting Officer*

JAMES E. ROGAN
*Director of the United States Patent and Trademark Office*